US011835298B2

(12) United States Patent
Lehtonen

(10) Patent No.: US 11,835,298 B2
(45) Date of Patent: Dec. 5, 2023

(54) HEAT EXCHANGER FOR A LOOPSEAL OF A CIRCULATING FLUIDIZED BED BOILER AND A CIRCULATING FLUIDIZED BED BOILER

(71) Applicant: Valmet Technologies Oy, Espoo (FI)

(72) Inventor: Pekka Lehtonen, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/704,632

(22) Filed: Mar. 25, 2022

(65) Prior Publication Data

US 2022/0325961 A1 Oct. 13, 2022

(30) Foreign Application Priority Data

Apr. 7, 2021 (FI) ..... 20215411

(51) Int. Cl.

| | |
|---|---|
| ***F28D 13/00*** | (2006.01) |
| ***F22B 31/00*** | (2006.01) |
| ***F23C 10/10*** | (2006.01) |
| ***F28F 9/22*** | (2006.01) |

(52) U.S. Cl.

CPC ..... *F28D 13/00* (2013.01); *F22B 31/0084* (2013.01); *F23C 10/10* (2013.01); *F28F 9/22* (2013.01); *F23C 2206/103* (2013.01)

(58) Field of Classification Search

CPC .... F28D 13/00; F23C 10/10; F23C 2206/103; F23C 10/20

See application file for complete search history.

(56) References Cited

U.S. PATENT DOCUMENTS

| | | | | |
|---|---|---|---|---|
| 5,054,436 | A | 10/1991 | Dietz | |
| 5,095,854 | A | 3/1992 | Dietz | |
| 5,184,671 | A | 2/1993 | Alliston et al. | |
| 2017/0284660 | A1* | 10/2017 | Chiu | F23C 10/22 |
| 2019/0249866 | A1* | 8/2019 | Lehtonen | F23J 1/00 |

FOREIGN PATENT DOCUMENTS

| | | | |
|---|---|---|---|
| WO | WO-2018/083367 | A1 | 5/2018 |
| WO | WO 2019/086752 | A1 | 5/2019 |

* cited by examiner

*Primary Examiner* — Eric S Ruppert

(74) *Attorney, Agent, or Firm* — Alston & Bird LLP

(57) ABSTRACT

A heat exchanger (10) suitable for recovering heat from bed material of a fluidized bed boiler (1). The heat exchanger (10) comprises first and second heat exchanger tubes (810, 820) and first and second feeding chambers (310, 320) configured to supply bed material to the first and second heat exchanger tubes (810, 820), respectively. The first heat exchanger tubes (810) are arranged on a first side of a plane (P) that intersects the first feeding chamber (310) and the second heat exchanger tubes (820) are arranged on a second side of the plane (P). The first feeding chamber (310) is configured to supply bed material to the second feeding chamber (320).

18 Claims, 6 Drawing Sheets

IVb - IVb

V - V

HEAT EXCHANGER FOR A LOOPSEAL OF A CIRCULATING FLUIDIZED BED BOILER AND A CIRCULATING FLUIDIZED BED BOILER

CROSS REFERENCE TO RELATED APPLICATIONS

This application claims priority to and the benefit of Finnish Patent Application No. 20215411, filed Apr. 7, 2021; the contents of which as are hereby incorporated by reference in their entirety.

BACKGROUND

Related Field

The invention relates to heat exchangers. The invention relates to particle coolers. The invention relates to loopseal heat exchangers. The invention relates to circulating fluidized bed boilers.

Description of Related Art

A fluidized bed heat exchanger is known from U.S. Pat. No. 5,184,671. The fluidized bed heat exchanger may be arranged in connection with a steam generator to recover heat from the bed material of the fluidized bed. Typically in such a heat exchanger steam is fed into the heat exchanger and becomes superheated, whereby such a fluidized bed heat exchanger may be referred to as a fluidized bed superheater. In a circulating fluidized bed boiler, a fluidized bed heat exchanger may be arranged in the loopseal. In such a case the heat exchanger may be referred to as a loopseal heat exchanger or a loopseal superheater.

The fluidized bed heat exchanger known from U.S. Pat. No. 5,184,671 comprises a heat exchange chamber (FIG. 1, B) provided with heat transfer tubes, and parallel thereto a bypass chamber (FIG. 1, C) without heat exchanger tubes. In the solution, the bypass chamber is as large as the heat exchange chamber. Since the heat exchanger comprises only one chamber provided with heat exchanger tubes, controlling the heat exchange by only controlling the fluidizing air velocities in these two chambers (B, C) to a sufficient degree is problematic. Accurate control is required in order to produce superheated steam of which temperature and pressure are optimized for a subsequent steam turbine. The steam turbine is typically sensitive to steam temperature and pressure.

A loopseal superheater with two separate heat exchange chambers is known e.g. from WO 2018/083367. Some parts of FIG. 2a of that publication are reproduced as FIG. 7 of this specification. Two separately controllable heat exchange chambers provide for better control of the heat exchange from the bed material to the steam. The two heat exchange chambers are reproduced in FIG. 7 and shown by the reference numerals 410, 420. As indicated in FIG. 7, two separate feeding chambers 310, 320, in prior art, are arranged side-by-side. Moreover, each one of the feeding chambers 310, 320 feeds bed material to only one of the heat exchange chambers 410, 420, respectively.

However, in recent years, the efficiency of particle separators used in circulating fluidized bed boilers has improved. This has resulted in the boiler having only a small particle separator, such as a cyclone. Also, demand for decentralized boiler units with smaller size and capacity is growing. This also indicates a tendency towards smaller particle separators. When the size of the particle separator decreases, typically less space is available for the heat exchanger. Moreover, oftentimes the heat exchangers are manufactured such that the builder thereof (i.e. a person) enters into a chamber or chambers of the heat exchanger to provide e.g. protective refractory on at least some parts of the walls of the heat exchanger. Thus, the individual chambers of the heat exchanger should be sufficiently large for manufacturing, i.e. for a person to enter therein. Yet, the overall size of the heat exchanger should be sufficiently small. Moreover, at the same time, the heat exchange from the bed material to the circulating steam should be accurately controllable.

BRIEF SUMMARY

In line with the needs, a purpose of the present invention is to present a heat exchanger that is suitable for use as a loopseal heat exchanger of a circulating fluidized bed. Moreover, the chambers of the heat exchanger are suitably large for a person to enter the heat exchanger, even if the overall size (at least in one direction) is reasonably small. Finally, at the same time, the heat exchange from the bed material flowing in between heat exchange tubes to the circulating steam flowing inside the tubes is accurately controllable.

For the purpose of recovering heat and controlling the heat exchange, the heat exchanger comprises first and second heat exchanger tubes such that the bed material is configured to run through a first feeding chamber to the first heat exchanger tubes and through a second feeding chamber to the second heat exchanger tubes. Moreover, in order to have both the feeding chambers sufficiently large, the first feeding chamber is configured to supply bed material to the second feeding chamber. This saves space compared e.g. to the solution of FIG. 7 where two separate feeding chambers 310, 320 are arranged side-by-side and to feed bed material only to only one of the heat exchange chambers.

The invention is disclosed in specific terms in claim 1. Other claims define preferable embodiments. The description explains the functioning of the heat exchanger of the preferred and other embodiments.

To illustrate different views of the embodiments, three orthogonal directions Sx, Sy, and Sz are indicated in the figures. The direction Sz is, in use of the heat exchanger, substantially vertical and upwards. In this way, the direction Sz is substantially reverse to gravity.

DETAILED DESCRIPTION OF VARIOUS EMBODIMENTS

Figure 1:
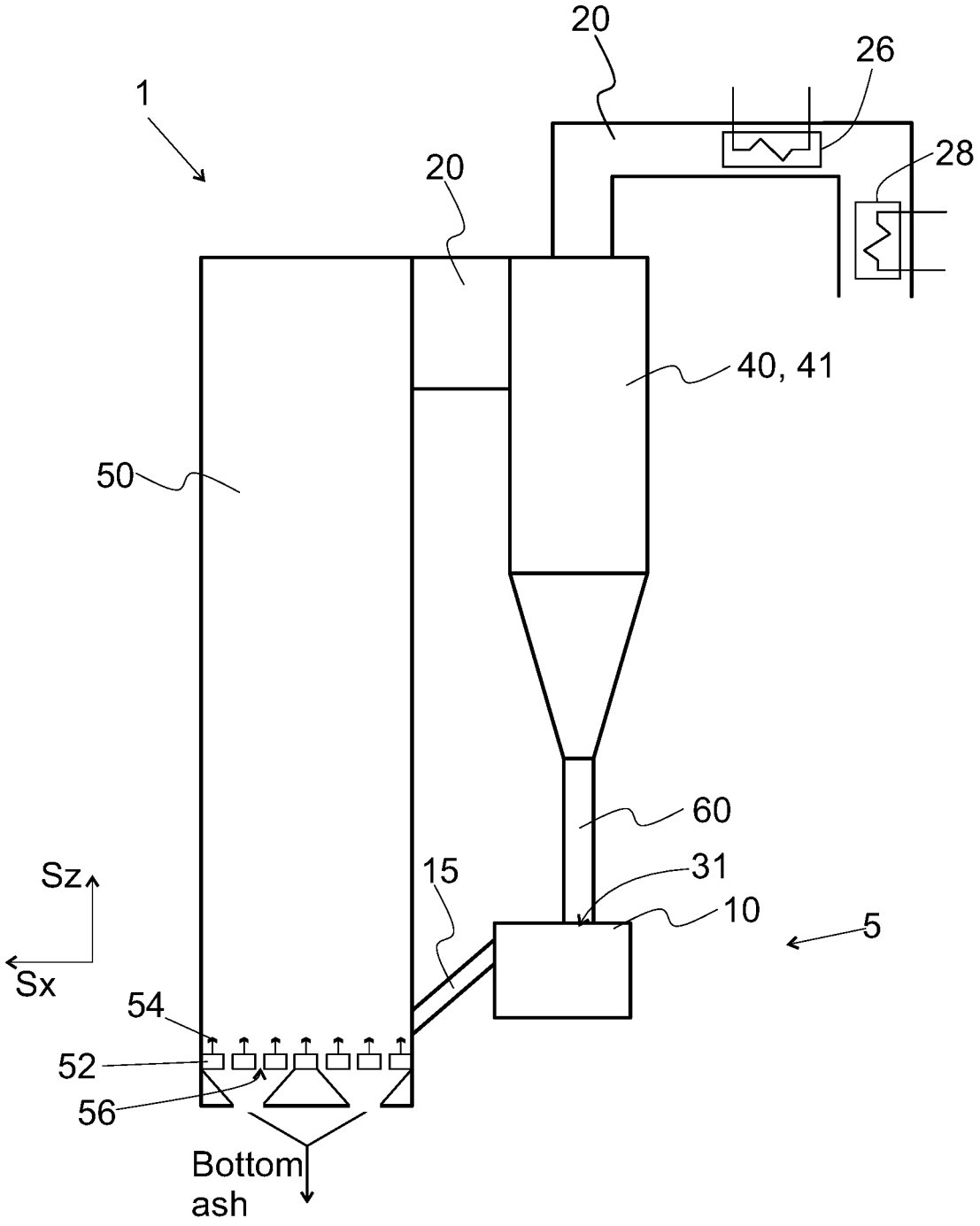
FIG. 1 shows a circulating fluidized bed boiler in a side view.

FIG. 1 shows a circulating fluidized bed boiler 1 in a side view. The circulating fluidized bed boiler 1 comprises a furnace 50, a particle separator 40 (such a cyclone 41), and a loopseal 5. In FIG. 1, flue gas channels are indicated by the reference number 20. Typically, the boiler 1 comprises heat exchangers 26, 28 within a flue gas channel 20, the heat exchangers 26, 28 being configured to recover heat from flue gases. Some of the heat exchangers may be superheaters 26 configured to superheat steam by recovering heat from flue gases. Some of the heat exchangers may be economizers 28 configured to heat and/or boil water by recovering heat from flue gases.

Within the furnace 50, some burnable material is configured to be burned. Some inert particulate material, e.g. sand, is also arranged in the furnace 50. The mixture of the particulate material and the burnable material and/or ash is referred to as bed material. At the bottom of the furnace 50, a grate 52 is arranged. The grate 52 is configured to supply air into the furnace in order to fluidize the bed material and to burn at least some of the burnable material to form heat, flue gas, and ash. In a circulating fluidized bed, the air supply is so strong, that the bed material is configured to flow upwards in the furnace 50. The grate 52 comprises grate nozzles 54 for supplying the air. The grate 52 limits bottom ash channels 56 for removing ash from the furnace 50.

From the upper part of the furnace 50, the bed material is conveyed through a flue gas channel 20 to the particle separator 40 in order to separate the bed material from gases. From the particle separator 40, e.g. cyclone 41, the separated bed material falls through a channel 60 to a loopseal 5. In the loopseal 5, a layer of bed material is formed. The layer prevents the combustion air or the fluidizing air from flowing in an opposite direction from the furnace 50 to the cyclone 40. At least when the loopseal 5 does not have a common wall with the furnace 50, the bed material is returned from the loopseal 5 to the furnace 50 via a pipeline 15 configured to convey bed material from the loopseal 5 to the furnace 50. If the loopseal 5 has a common wall with the furnace 50, the bed material is returned from the loopseal 5 directly to the furnace 50.

Referring to FIG. 1, a heat exchanger 10 is arranged in the loopseal 5. Thus, the heat exchanger 10, may be referred to, alternatively, as a loopseal heat exchanger, since it suitable for being used in a loopseal. Moreover, in contrast to the heat exchanger 26, 28, the heat exchanger 10 is configured to recover heat from the particulate material, i.e. the bed material, circulating within the loopseal 5. The channel 60 is connected to an inlet 31 of the heat exchanger 10. The inlet 31 is for letting in bed material to the heat exchanger 10. Thus, the heat exchanger 10 is suitable for recovering heat from particulate bed material of the fluidized bed boiler 1.

Referring to FIGS. 2 to 5, the heat exchanger 10 comprises walls (including the walls 510, 520, 530, 540, and 550) dividing the heat exchanger 10 to different chambers (including 100, 310, 320, 410, 420, and 200). The chambers have floors (including 102, 202, 312, and 322) and ceilings (shown without reference numbers).

Herein the term "chamber" refers to a space within the heat exchanger 10 that is separated from another chamber by a wall, i.e. a wall that is, in use, vertical. As detailed below, the wall separating the chamber from a neighbouring chamber needs not extend a full length from a floor to a ceiling of the chamber.

Figure 2:
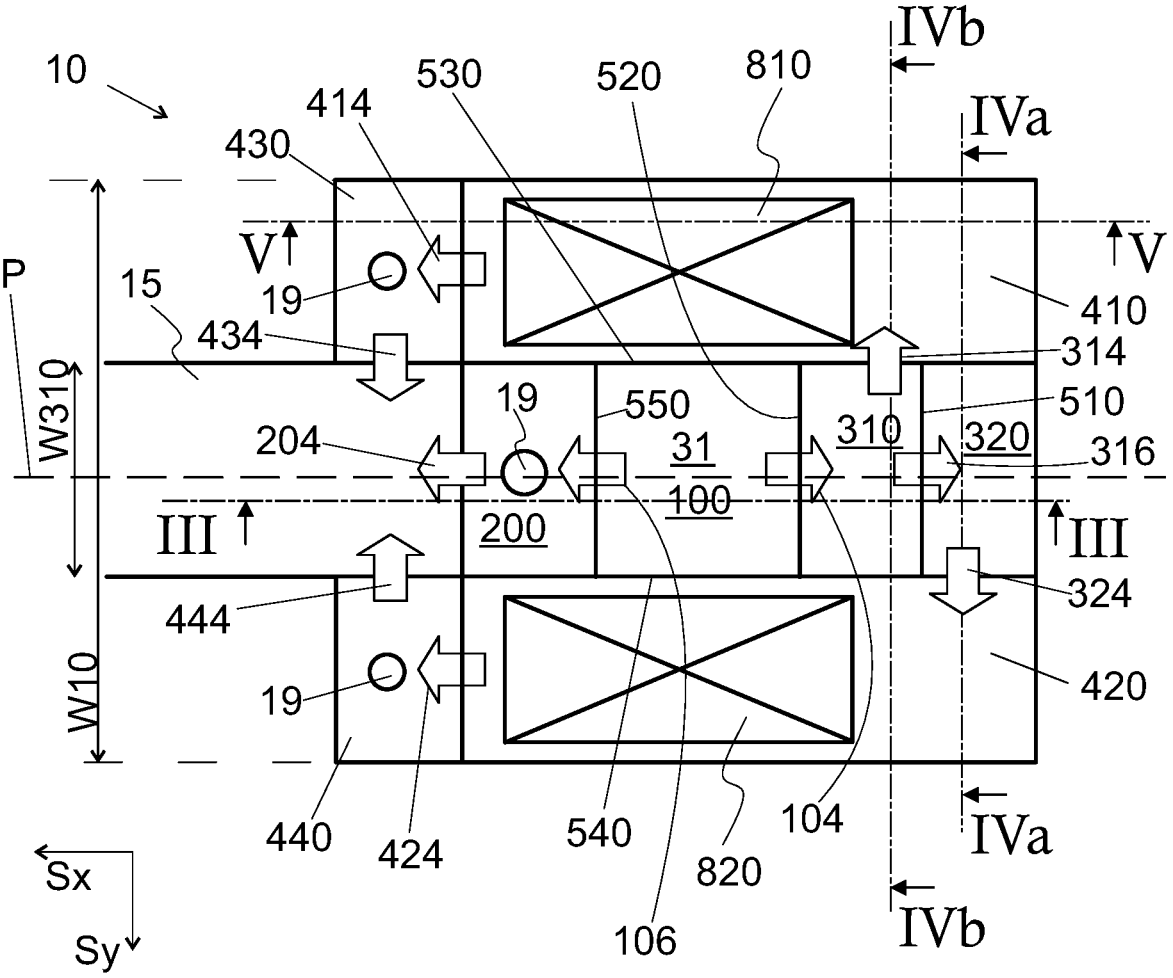
FIG. 2 shows different chambers of a heat exchanger in a top view.

Referring to FIG. 2, the heat exchanger 10 comprises first heat exchanger tubes 810 and second heat exchanger tubes 820. A purpose of the heat exchanger tubes 810, 820 is to recover heat from the hot bed material flowing within the heat exchanger 10.

The heat exchanger 10 comprises a first feeding chamber 310 configured to supply bed material to the first heat exchanger tubes 810. The heat exchanger 10 comprises a second feeding chamber 320 configured to supply bed material to the second heat exchanger tubes 820. The purpose of the feeding chambers 310, 320 is to control the amount of bed material flowing on one hand to the first heat exchanger tubes 810 and on the other hand to the second heat exchanger tubes 820. Moreover, in order to control the heat exchange, the first and second heat exchanger tubes 810, 820 are not arranged in the same chamber of the heat exchanger 10. In other words, the first and second heat exchanger tubes 810, 820 are arranged at different locations of the heat exchanger 10. More specifically, the first heat exchanger tubes 810 are arranged only on a first side of a plane P and the second heat exchanger tubes 820 are arranged only on a second, opposite, side of the plane P. Preferably, the heat exchanger tubes 810, 820 are arranged in such a manner relative to a plane P that is, in use, configured to be vertical; i.e. only on opposite sides of the plane P. Preferably, the first heat exchanger tubes 810 are arranged only on the first side and the second heat exchanger tubes 820 are arranged only on the second side of a plane P that intersects with at least one of the first feeding chamber 310 and the second feeding chamber 320; and that is, in use, configured to be vertical. More preferably, the first heat exchanger tubes 810 are arranged only on the first side and the second heat exchanger tubes 820 are arranged only on the second side of the plane P that intersects with both the first feeding chamber 310 and the second feeding chamber 320.

In FIG. 2, at least a part of the first feeding chamber 310 is arranged between the first heat exchanger tubes 810 and the second heat exchanger tubes 820. However, the tubes 810, 820 need not fill the heat exchange chambers 410, 420. In such a case, even if the first feeding chamber 310 is arranged between the heat exchange chambers 410, 420 provided with the heat exchanger tubes 810, 820, respectively, not even a part of the first feeding chamber 310 needs to be arranged between the first and second heat exchanger tubes 810, 820.

The first feeding chamber 310 is configured to supply bed material to the second feeding chamber 320. As depicted in FIG. 2 by an arrow, the first feeding chamber 310 comprises an outlet 316 for letting out bed material from the first feeding chamber 310 to the second feeding chamber 320.

This has the effect, that a width W310 in the direction Sy of the first feeding chamber 310 (and optionally a width of the second feeding chamber 320, too) remains larger than if the feeding chambers 310, 320 were arranged next to each other in the direction Sy. Moreover, because a purpose of the heat exchanger tubes 810, 820 is to recover heat, preferably, they are designed to be relatively long in at least one direction, which in FIG. 2 is denoted by Sx. Thus, even if the size of the heat exchanger 10 should be reduced, for efficient heat recovery at least a length of the heat exchange chambers 410, 420 should be kept as long as possible. Therefore, typically there is space available in the Sx direction particularly for such chambers that do not comprise heat exchanger tubes. In this way, space is saved, and accurate control of heat transfer is possible.

Preferably, the feeding of the bed material to the heat exchanger tubes 810, 820 can be controlled independently of each other. Thus, in an embodiment, the first feeding chamber 310 is configured to supply bed material only to the first heat exchanger tubes 810 and to the second feeding chamber 320. Moreover, in an embodiment, the second feeding chamber 320 configured to supply bed material only to the second heat exchanger tubes 820.

Because the first feeding chamber 310 is configured to supply bed material to the second feeding chamber 320, in a preferable embodiment, the second feeding chamber 320 is configured to receive bed material only from the first feeding chamber 310. For example, in an embodiment, an inlet chamber 100 is configured to supply bed material to the first feeding chamber 310, and the inlet chamber 100 is configured to supply bed material to the second feeding chamber 320 only through the first feeding chamber 310. As detailed below, the inlet chamber 100 may be configured to supply bed material also to a bypass chamber 200.

The white arrows in FIG. 2 indicate outlets (104, 314, 414, 434, 316, 324, 424, 444, 106, 204) for bed material of the different chambers. In FIG. 2, such arrows that do not have an overlapping line (i.e. the arrows for the outlets 314, 324, 434, 444, and 204) relate to outlets at an upper part of a chamber. In FIG. 2, such arrows that do have an overlapping line or lines (i.e. the arrows for the outlets 104, 106, 316, 414, and 424) relate to outlets at a lower part of a chamber. The outlets may be formed as apertures on the walls. In the alternative, an outlet at a lower part of a chamber may be formed e.g. by a wall that extends from a ceiling downwards, but not to the level of a floor. Correspondingly, an outlet at an upper part of a chamber may be formed e.g. by a wall that extends from a floor upwards, but not to the level of a ceiling.

In use, a first part of the bed material flows between the first heat exchanger tubes 810. A second part of the bed material flows between the second heat exchanger tubes 820. A third part of the bed material flows through the bypass chamber 200 and bypasses both the first and second heat exchanger tubes 810, 820.

Referring to FIGS. 1 and 2, the bed material enters the heat exchanger 10 via an inlet 31, which is arranged within an inlet chamber 100. From the inlet chamber 100, the bed material (i.e. the first part and the second part of the bed material) may enter the first feeding chamber 310 through an outlet 104 (see FIG. 2). This is also indicated by the arrow A12 in FIG. 3. In addition or alternatively, from the inlet chamber 100, the bed material (i.e. the third part of the bed material) may enter a bypass chamber 200 through an outlet 106 (see FIG. 2). This is also indicated by the arrow A3 in FIG. 3. As indicated in FIG. 2, the inlet chamber 100 is configured to supply bed material only to the bypass chamber 200 and to the first feeding chamber 310. Naturally, as detailed above, the second part of the bed material flows through the first feeding chamber 310 to the second feeding chamber 320.

From the first feeding chamber 310 the first part of the bed material runs to the first heat exchange chamber 410 through the outlet 314 (see FIG. 2). In the first heat exchange chamber 410, the bed material runs between the first heat exchanger tubes 810 to the outlet 414 thereby heating the heat transfer medium (typically steam) running within the first heat exchanger tubes 810. The bed material runs through the outlet 414 to a first outlet chamber 430, and through the outlet 434 to the pipeline 15, and eventually back to the furnace 50. In case the heat exchanger 10 has a common wall with the furnace 50, the outlet 434 may open directly to the furnace 50. In the alternative, the outlet 414 may open directly to the furnace 50, whereby the first outlet chamber 430 may be omitted.

Concerning the circulation of the second part of the bed material, the second part of the bed material runs from the first feeding chamber 310 to the second feeding chamber 320 through the outlet 316 (see FIG. 2). From the second feeding chamber 320, the second part of the bed material runs to the second heat exchange chamber 420 through the outlet 324. In the second heat exchange chamber 420, the bed material runs between the second heat exchanger tubes 820 to the outlet 424 thereby heating the heat transfer medium (typically steam) running within the second heat exchanger tubes 820. The bed material runs through the outlet 424 to a second outlet chamber 440, and through the outlet 444 to the pipeline 15, and eventually back to the furnace 50. In case the heat exchanger 10 has a common wall with the furnace 50, the outlet 444 may open directly to the furnace 50. In the alternative, the outlet 424 may open directly to the furnace 50, whereby the second outlet chamber 440 may be omitted.

As detailed above, heat is thus recovered from both the first part of the bed material and the second part of the bed material by the first and second heat exchanger tubes 810, 820, respectively. However, in some cases heat needs not to be recovered from bed material, or less heat exchange is needed. Thus, the third part of the bed material may bypass both the first and second heat transfer tubes 810, 820. As for a circulation of the third part of the bed material, from the bypass chamber 200 the bed material may exit to the pipeline 15 through an outlet 204. In the alternative, outlet 204 may open directly to the furnace 50.

One or some of the chambers of the heat exchanger 10 may be provided with an ash removal channel 19. A purpose of the ash removal channel is to remove bottom ash from the heat exchanger 10. Another purpose of the ash removal channel is for draining the bed material out of the heat exchanger for maintenance purposes. If bottom ash is removed from the heat exchanger 10 during operation thereon, the hot bottom ash may be conveyed to an ash cooler 600 (see FIG. 5) for recovering heat from the ash.

Thus, in an embodiment, the heat exchanger 10 is provided in a loopseal 5 of a circulating fluidized bed boiler 1. With reference to FIG. 1, according to an embodiment, a circulating fluidized bed boiler 1 comprises a furnace 50, a particle separator 40 (such as a cyclone 41) that is configured to separate bed material from flue gases receivable from the furnace 50, and a loopseal 5 configured to receive the separated bed material from the particle separator 40. In the embodiment, the loopseal 5 is provided with the heat exchanger 10 as disclosed above and as will be disclosed below.

In the embodiment of the circulating fluidized bed boiler 1, the heat exchanger 10 is arranged such that at least a part of the separated bed material is configured to run through the first feeding chamber 310. It is noted that another part of the bed material may run through the bypass chamber. The bed material may run to only one of the chambers 310, 200 at a time. However, in a typical use, a part of the bed material runs to the first feeding chamber 310 at the same time another part of the bed material runs to the bypass chamber 200. Moreover, the first part of the separated bed material is configured to run from the first feeding chamber 310 to the first heat exchanger tubes 810. Furthermore, the second part of the separated bed material is configured to run from the first feeding chamber 310 to the second feeding chamber 320 and through the second feeding chamber 320 to the second heat exchanger tubes 820. As detailed above, the first part of the separated bed material is configured to run from the first feeding chamber 310 to the first heat exchanger tubes 810 without running through the second feeding chamber 320. As indicated above, the third part of the separated bed material is configured to run to the bypass chamber 200, and configured to bypass both the first and the second heat exchanger tubes 810, 820.

Figure 3:
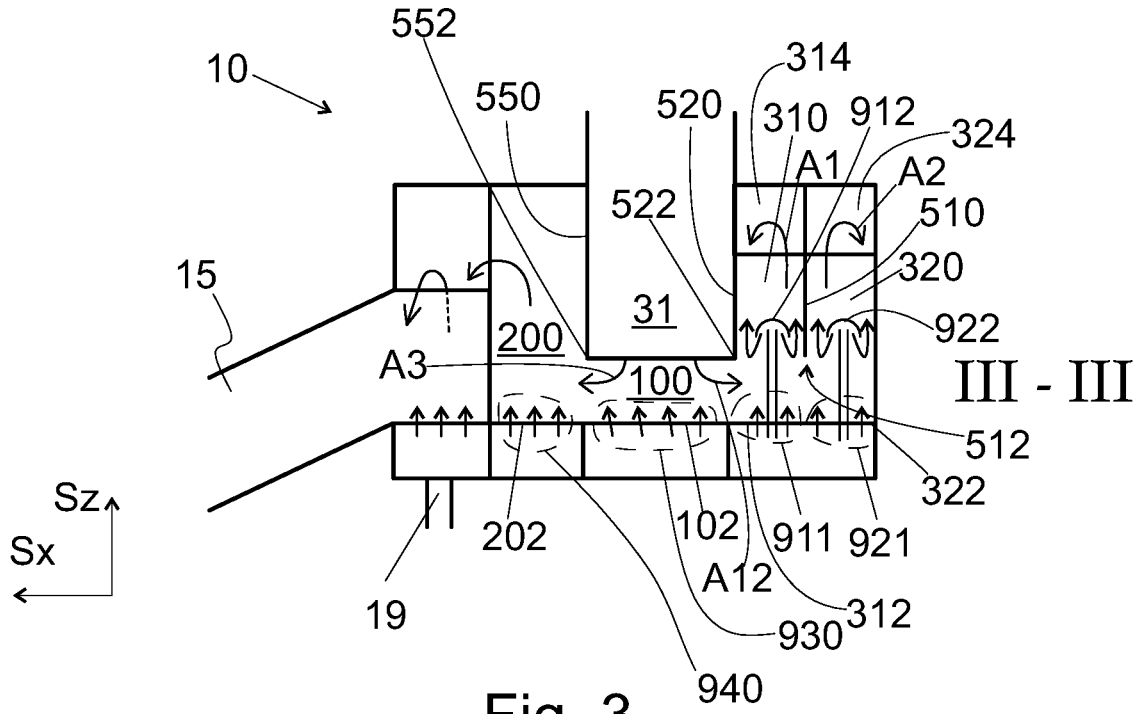
FIG. 3 shows the sectional view III-III of the heat exchanger of FIG. 2, the section III-III indicated in FIG. 2.
Figure 4A:
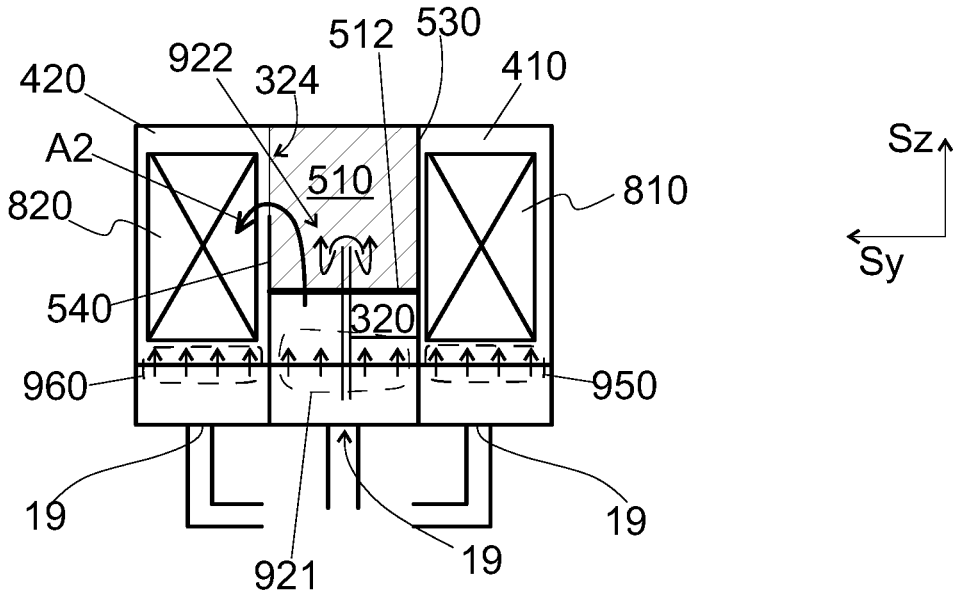
FIG. 4*a* shows the sectional view IVa-IVa of the heat exchanger of FIG. 2, the section IVa-IVa indicated in FIG. 2.

To provide the outlet 316 to the heat exchanger 10 and to guide the bed material as indicated above, in an embodiment, the heat exchanger 10 comprises a first wall 510 that limits the first feeding chamber 310 and the second feeding chamber 320. I.e. the first wall 510 separates an upper part of the first feeding chamber 310 from an upper part of the second feeding chamber 320. The first wall 510 is shown in FIGS. 2, 3, and 4*a*. The first wall 510 is, in use, vertical. As shown in FIGS. 3 and 4*a*, the first wall 510 comprises a first lower edge 512. In use of the heat exchanger, the first lower edge 512 is arranged at a higher vertical level than a floor 312, 322 or floors 312, 322 of the first feeding chamber 310 and the second feeding chamber 320. The floors are shown in FIG. 3. More precisely, if the floors 312, 322 are arranged on the same vertical level, the first lower edge 512 is arranged at a higher vertical level than this. However, if the floors 312, 322 are not arranged on the same vertical level, the first lower edge 512 is arranged at a higher vertical level than the higher floor of these two. In this way, the first feeding chamber 310 is configured to supply bed material to the second feeding chamber 320 from between the first lower edge 512 of the first wall 510 and floor(s) (312, 322) of the first and second feeding chambers 310, 320. The first lower edge 512 needs not be as wide as the feeding chambers (310, 320). In contrast, the first lower edge may be an upper edge of an aperture provided in the first wall 510.

Preferably, the floors 312, 322 of the first feeding chamber 310 and the second feeding chamber 320 are arranged on the same vertical level. Moreover, preferably the first lower edge 512 of the first wall 510 is not arranged on top of a part of the first wall 510. I.e. if the first lower edge 512 is an upper edge of an aperture of the wall 510, the aperture extends to the level of the floors (312, 322), or extends to a level of higher of the floors if not on the same level. This has the effect that the bed material may easily run from the first feeding chamber 310 to the second 320 feeding chamber.

It is noted that throughout this description the term "vertical level" refers to a position in the vertical direction, i.e. an altitude. For example, a horizontal plane is arranged at a vertical level. The vertical level thus defines the position of the horizontal plane.

In order to control the flow of the bed material through the various chambers, and in this way to control the heat exchange from bed material to steam, the heat exchanger 10 is provided with nozzles for fluidizing the bed material.

Referring to FIG. 3, preferably, the heat exchanger 10 comprises primary first nozzles 911. The primary first nozzles 911 are, in use, arranged at a lower vertical level than the first lower edge 512 of the first wall 510. I.e. the primary first nozzles 911 are, in use, arranged below the first lower edge 512 of the first wall 510, but not necessarily directly below. Moreover, the primary first nozzles 911 are arranged in the first feeding chamber 310. Furthermore, the primary first nozzles 911 are configured fluidize bed material in the first feeding chamber 310. In a similar manner, the heat exchanger 10 comprises primary second nozzles 921. The primary second nozzles 921 are, in use, arranged at a lower vertical level than the first lower edge 512 of the first wall 510. The primary second nozzles 921 are arranged in the second feeding chamber 320. The primary second nozzles 921 are configured fluidize bed material in the second feeding chamber 320. By using the nozzles 911, 921, the bed material will become fluidized so as to flow from the chamber 310 to the chamber 320, and also through the chambers 310 and 320.

By controlling the air flow through these nozzles 911, 921, one can control how the bed material that runs to the first feeding chamber 310 is divided to the first part, which runs to the tubes 810, and to the second part, which runs to the tubes 820.

Thus, in an embodiment of the circulating fluidized bed boiler 1 comprising the heat exchanger 10, an amount of fluidizing air fed through the primary first nozzles 911 is configured to be controlled independently of an amount of fluidizing air fed through the primary second nozzles 921. The control of air can be controlled e.g. by controlling the nozzles (911, 921) and/or controlling baffle plates affecting the air flow to the nozzles (911, 921). E.g. a first baffle may control the air flow to the nozzles 911 and a second baffle may control the air flow to the nozzles 921. The control may be automated. A control unit may be configured to control the nozzles and/or the baffle(s) accordingly.

However, it has been noticed that because of the outlet 316 (see FIG. 2; or FIG. 3, where the outlet, not shown, remains below the edge 512) in between the first and second feeding chambers 310, 320, some of the air from primary first nozzles 911 is easily guided to the second feeding chamber 320 and in a similar manner, some of the air from primary second nozzles 921 is easily guided to the first feeding chamber 310. This makes the accurate control of bed material flow reasonably cumbersome. However, nozzles 911, 921 are beneficially arranged below the first lower edge 512 to provide bed material transfer through the outlet 316.

In order to provide for more accurate control, an embodiment of the heat exchanger 10 comprises secondary first nozzles 912 (see FIG. 3). The secondary first nozzles 912 are arranged, in use, at a higher vertical level than the first lower edge 512 of the first wall 510. I.e. the secondary first nozzles 912 are arranged, in use, above the first lower edge 512 of the first wall 510, but not necessarily directly above. The secondary first nozzles 912 are arranged in the first feeding chamber 310. The secondary first nozzles 912 are configured fluidize bed material in the first feeding chamber 310. Because the secondary first nozzles 912 are arranged at a higher vertical level than the first lower edge 512 of the first wall 510 only a minute amount of the fluidizing air from these nozzles 912, if any, runs to the second feeding chamber 320.

In a corresponding manner, in an embodiment, the heat exchanger 10 comprises secondary second nozzles 922. The secondary second nozzles 922 are arranged, in use, at a higher vertical level than the first lower edge 512 of the first wall 510. The secondary second nozzles 922 are arranged in the second feeding chamber 320. The secondary second nozzles 922 are configured fluidize bed material in the second feeding chamber 320. Because the secondary second nozzles 922 are arranged at a higher vertical level than the first lower edge 512 of the first wall 510 only a minute amount of the fluidizing air from these nozzles, if any, runs to the first feeding chamber 310.

By controlling the air flow through these nozzles 912, 922, one can control how the bed material that runs to the first feeding chamber 310 is divided to the first part, which runs to the tubes 810, and to the second part, which runs to the tubes 820.

Thus, in an embodiment of the circulating fluidized bed 1 comprising the heat exchanger 10, an amount of fluidizing air fed through the secondary first nozzles 912 is configured to be controlled independently of an amount of fluidizing air fed through the secondary second nozzles 922. Preferably, at the same time, an amount of fluidizing air fed through the primary first nozzles 911 is configured to be controlled independently of an amount of fluidizing air fed through the primary second nozzles 921. What has been said about controlling air flow through the nozzles by using the nozzles and/or a baffle/baffles and/or a controller applies.

It has been found that when the bed material flow is controlled so that an air flow through the secondary first nozzles 912 and/or through the secondary second nozzles 922 is low, there is a tendency of the bed material to enter into these nozzles 912, 922. To prevent bed material from entering to the nozzles, and possibly also clogging the nozzles, the nozzles may be closed from top. Thus, in an embodiment, the secondary first nozzles 912 are closed from top so as to prevent bed material from entering into the secondary first nozzles 912 and the secondary second nozzles 922 are closed from top so as to prevent bed material from entering into the secondary second nozzles 922.

Figure 6A:
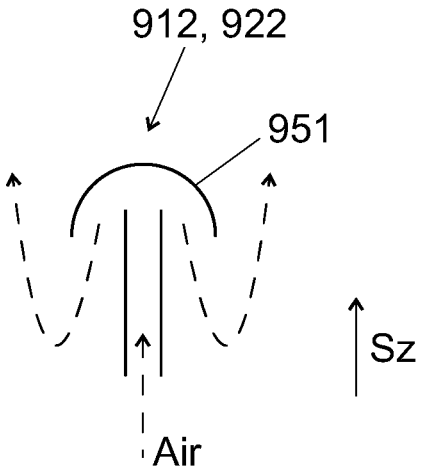
Figure 6B:
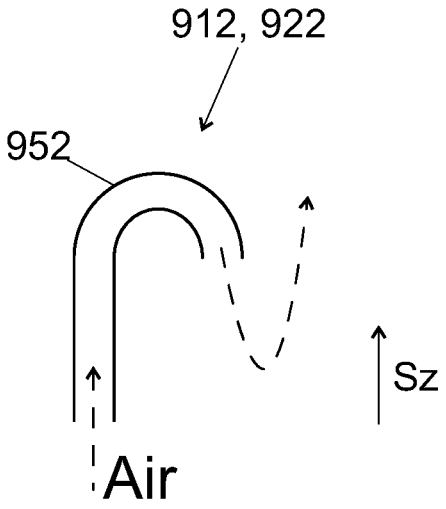
Figure 6C:
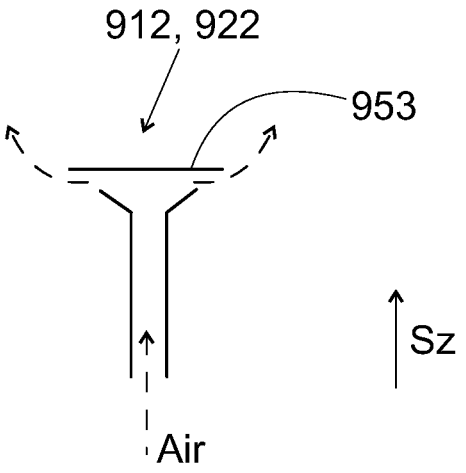
Figure 6D:
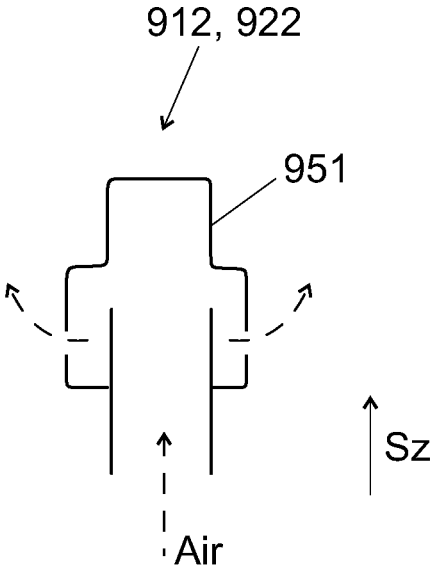

FIG. 3 shows a curved lid or roof for the nozzles 912, 922 to prevent the bed material flow into the nozzles 912, 922. This construction is shown in more detail in FIG. 6*a*. Therein the curved lid or roof 951 is shown by its own reference number. Therein the dotted lines indicate flow of air. The nozzles can also be otherwise closed from top. For example in the embodiment of FIG. 6*b*, the nozzle has a curved shape, forming an U-shape that opens downwards. Thus, a part 952 of a curved pipe closes the nozzle from above (i.e. from top). Moreover, as indicate in FIG. 6*c*, a flat lid or roof 953 may suffice to prevent bed material for entering into the nozzle. Furthermore, many parts of a lid or roof 951 may be substantially vertical, as indicated in FIG. 6*d*.

If needed, also the primary first nozzles 911 may be closed from top so as to prevent bed material from entering into the primary first nozzles 911. If needed, also the primary second nozzles 921 may be closed from top so as to prevent bed material from entering into the primary second nozzles 921.

As indicated above, in an embodiment, the second feeding chamber 320 comprises an outlet 324 for supplying bed material to the second heat exchange chamber 420 (see FIGS. 2 and 3). Preferably, in such a case, the outlet 324 of the second feeding chamber 320 is arranged, in use, at a higher vertical level than the first lower edge 512. Reference is made to FIG. 4*a*. More specifically, preferably, the whole outlet 324 is arranged at a higher vertical level than the first lower edge 512. The outlet 324 may be limited by an upper edge of a wall separating a lower part of the second feeding chamber 320 from the second heat exchange chamber 420. A curved arrow A2 in FIGS. 4*a* and 3 indicates flow of bed material above such a wall through the outlet 324. Having the outlet 324 arranged above the first lower edge 512 has the technical effect that the second feeding chamber 320 serves as a gas lock and, for its part, prevents the bed material from running in wrong, opposite, direction (i.e. not from the chamber 420 via the chamber 320 to the chamber 310).

Preferably, the outlet 324 of the second feeding chamber 320 is also arranged at a higher vertical level than the secondary second nozzles 922. This has the effect that the secondary second nozzles 922 can more reliably be used to control the bed material flow. Thus, the bed material thus not escape the second feeding chamber through the outlet 324 before it is fluidized by the air from secondary second nozzles 922.

Figure 4B:
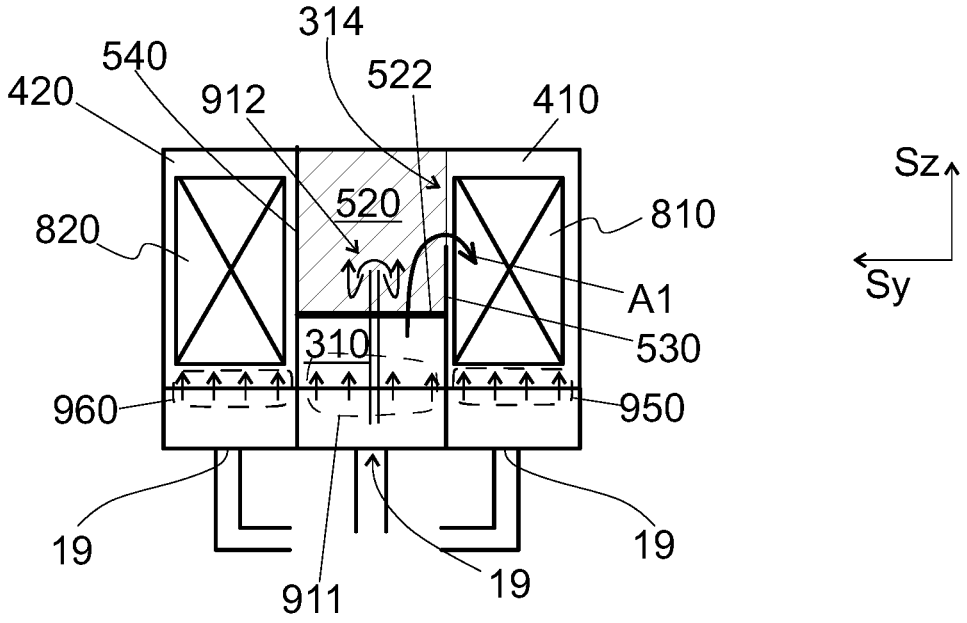
FIG. 4*b* shows the sectional view IVb-IVb of the heat exchanger of FIG. 2, the section IVb-IVb indicated in FIG. 2.

Referring to FIGS. 3 and 4*b*, in an embodiment the heat exchanger 10 comprises a second wall 520 that limits the inlet chamber 100 and the first feeding chamber 310. The second wall 520 is, in use, vertical. The second wall 520 comprises a second lower edge 522 that is arranged at a higher vertical level than a floor 312, 102 or floors 312, 102 of the inlet chamber 100 and the first feeding chamber 310. More precisely, if the floors 312, 102 are arranged on the same vertical level, the second lower edge 522 is arranged at a higher vertical level than this. However, if the floors 312, 102 are not arranged on the same vertical level, the second lower edge 522 is arranged at a higher vertical level than the higher floor of these two. In this way, the inlet chamber 100 is configured to supply bed material to the first feeding chamber 310 from between the second lower edge 522 of the second wall 520 and floor(s) (102, 312) of the inlet chamber 100 and the first feeding chamber 310. The second lower edge 522 needs not be as wide as the first feeding chamber 310 or the inlet chamber 100. In contrast, the second lower edge 522 may be an upper edge of an aperture provided in the second wall 520.

Preferably, the floors 312, 102 of the first feeding chamber 310 and the inlet chamber 100 are arranged on the same vertical level. Moreover, preferably the second lower edge 522 of the second wall 520 is not arrange on top of a part of the second wall 520. I.e. if the second lower edge 522 is an upper edge of an aperture, the aperture extends to the level of the floor (or higher of the floors). This has the effect that the bed material may easily run from the inlet chamber 100 to the first feeding chamber 310.

If the heat exchanger comprises both the second wall 520 and the secondary first nozzles 912, preferably, the secondary first nozzles 912 are arranged at a higher vertical level than the second lower edge 522 of the second wall 520. This has the effect that the air blown by the secondary first nozzles 912 does not easily flow to the inlet chamber 100 and/or to the channel 60 through the inlet 31 (see FIGS. 3 and 1).

Preferably, when the heat exchanger comprises both the first wall 510 and the second wall 520, these walls are parallel. Moreover, preferably, the first lower edge 512 is not arranged, in use, at a lower vertical level than the second lower edge 522. This ensures proper functioning of the first feeding chamber 310, because then there is a tendency of the bed material running from the first feeding chamber 310 to the second feeding chamber 320 rather than running from the first feeding chamber 310 back to the inlet chamber 100. In FIG. 3, these edges 512, 522 are arranged at substantially the same vertical level.

In an embodiment, the first feeding chamber 310 is arranged between the inlet chamber 100 and the second feeding chamber 320. Reference is made to FIG. 2. As detailed above, for efficient heat recovery, at least a length of the heat exchange chambers 410, 420 should be kept as long as possible. Thus, typically there is space available particularly in this direction for these chambers 100, 310, 320. To clarify, in a preferable embodiment, the inlet chamber 100, the first feeding chamber 310, and the second feeding chamber 320 are arranged next to a first heat exchange chamber 410 provided with the first heat exchanger tubes 810. Herein the term "next to" means that only one vertical wall is arranged in between two chambers that are next to each other. Preferably also, the inlet chamber 100, the first feeding chamber 310, and the second feeding chamber 320 are arranged next to a second heat exchange chamber 420 provided with the second heat exchanger tubes 820.

In other words, in an embodiment the heat exchanger 10 comprises a third wall 530 limiting the first heat exchange chamber 410 and a fourth wall 540 limiting the second heat exchange chamber 420. These walls 530, 540 are shown e.g. in FIGS. 2, 4*a*, and 4*b*. In use, the third wall 530 is vertical and the fourth wall 540 is vertical. Moreover, in the embodiment of FIG. 2, the third wall 530 is parallel to the fourth wall 540. Furthermore, in FIG. 2, at least a part of the first wall 510 is arranged between the third wall 530 and the fourth wall 540. It is noted that the first wall may extend in the vertical direction longer than the walls 530, 540. In an embodiment, the first wall 510 is perpendicular to the third wall 530. Also, if the second wall 520 is present, preferably, at least a part thereof is arranged between the third wall 530 and the fourth wall 540. In an embodiment, the second wall 520 is perpendicular to the third wall 530. In an embodiment, a part of the third wall 530 limits the first feeding chamber 310. In an embodiment, a part of the third wall 530 limits the second feeding chamber 320. In an embodiment, a part of the fourth wall 540 limits the first feeding chamber 310. In an embodiment, a part of the fourth wall 540 limits the second feeding chamber 320.

More preferably, in addition, the inlet chamber 100 is arranged in between the first feeding chamber 310 and the bypass chamber 200. In such a case, the bypass chamber 200 may be arranged next to the first heat exchange chamber 410. In addition or alternatively, the bypass chamber 200 may be arranged next to the second heat exchange chamber 420. Correspondingly, in the embodiment of FIG. 2, a part of the third wall 530 limits also the bypass chamber 200. Furthermore, a part of the forth wall 540 limits also the bypass chamber 200.

In order to enhance the material flow from the inlet chamber 100 to the bypass chamber 200 and to the first inlet chamber 310, in an embodiment, the heat exchanger 10 comprises third nozzles 930 arranged at a lower part of the inlet chamber 100 and configured to fluidize bed material in the inlet chamber 100. Reference is made to FIG. 3.

Preferably, a width W310 of the first feeding chamber 310 is at least 500 mm. This allows for an operator to enter the first feeding chamber 310 e.g. during manufacturing thereof. Herein, the width W310 is defined in a direction that is parallel to a direction of a minimum distance between the first heat exchanger tubes 810 and the second heat exchanger tubes 820. In case the heat exchanger comprises the third and fourth walls 530, 540 and parts of the walls 530, 540 limit the first feeding chamber 310, the width W310 remains in between the third wall 530 and the fourth wall 540.

Figure 7:
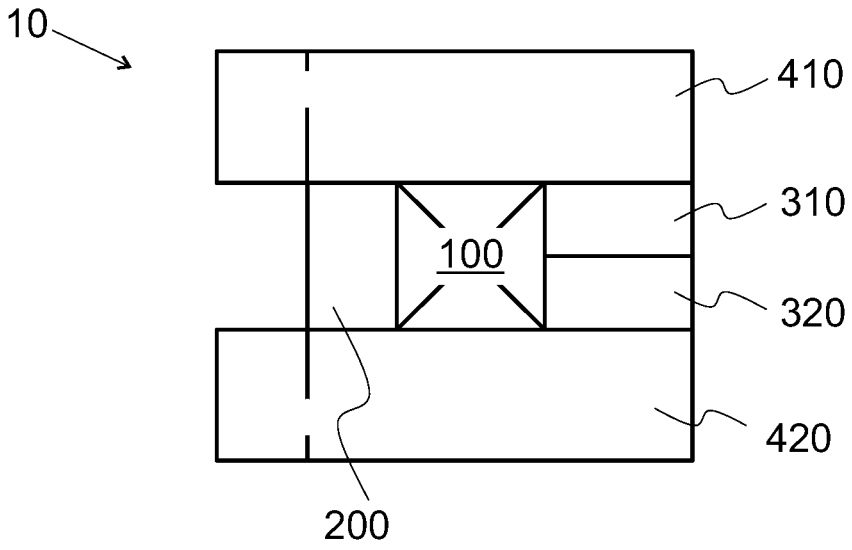
Fig. 7 PRIOR ART
FIG. 7 shows a solution of prior art.

As for an upper limit for the width W310 there is not any technical reasons other than the size of the heat exchanger 10 for an upper limit. However, if the width W310 is so high that the first feeding chamber 310 can be divided to two parts side by side in the direction of the width W310 in such a way that a person can enter the parts, then there is no technical reason to guide the bed material through the first feeding chamber 310 to the second feeding chamber 320. Instead, the first and second feeding chambers 310, 320 could be arranged side by side and the bed material could be arranged to flow into each directly from the inlet chamber 100, as indicated in FIG. 7. Moreover, typically a width and a length of the inlet chamber 100 are equal to a width and a length of the channel 60 at the inlet 31 (see FIG. 6). Moreover, for manufacturing reasons, the width W310 is preferably equal to the width of the inlet chamber 100. For these reasons, the width W310 may be e.g. from 500 mm to 1600 mm.

For similar reasons, the width W10 of the whole heat exchanger 10, as defined in a direction that is parallel to a direction of a minimum distance between the first heat exchanger tubes 810 and the second heat exchanger tubes 820, may be e.g. at least 4000 mm. The width W10 may be e.g. from 4000 mm to 7700 mm.

As detailed above, bed material may enter the first heat exchange chamber 410 through the outlet 314 from the first feeding chamber 310 (see FIG. 2). Preferably, the outlet 314 of the first feeding chamber 310 is arranged, in use, at a higher vertical level than the second lower edge 522 of the second wall 520 (see FIG. 4*b*). More specifically, preferably, the whole outlet 314 is arranged at a higher vertical level than the second lower edge 522. The outlet 314 may be limited by an upper edge of a wall separating a lower part of the first feeding chamber 310 from the first heat exchange chamber 410. A curved arrow A1 in FIGS. 4*b* and 3 indicates flow of bed material above such a wall through the outlet 314. Having the outlet 314 arranged above the second lower edge 522 has the technical effect that the first feeding chamber 310 serves as a gas lock and, for its part, prevents the bed material from running in a wrong, opposite, direction (i.e. not from the chamber 410 via the chamber 310 to the chamber 100).

In addition or alternatively, preferably, the outlet 314 of the first feeding chamber 310 is arranged, in use, at a higher vertical level than the first lower edge 512 of the first wall 510 (see FIG. 3). More specifically, preferably, the whole outlet 314 is arranged at a higher vertical level than the first lower edge 512. Having the outlet 314 arranged above the first lower edge 512 has the technical effect that the flow of the material can be better controlled.

Preferably, the outlet 314 of the first feeding chamber 310 is arranged, in use, at a higher vertical level than the secondary first nozzles 912 (see FIG. 3). This has the effect that the secondary first nozzles 912 are able to fluidize the bed material in the first feeding chamber 310 before it escapes to the first heat exchange chamber 410. In this way this improves control of the material flow.

Referring to FIGS. 2 and 3, in an embodiment, the heat exchanger 10 comprises a fifth wall 550 limiting a bypass chamber 200 and an inlet chamber 100. In this way, the fifth wall 550 separates at least an upper part of the bypass chamber 200 from the inlet chamber 100. As detailed above, the inlet chamber 100 comprises the inlet 31 for the bed material. The fifth wall 550 comprises a fifth lower edge 552 (see FIG. 3). The fifth lower edge 552 is arranged, in use, at a higher vertical level than a floor 202, 102 or floors 202, 102 of the inlet chamber 100 and the bypass chamber 200. In this way, the inlet chamber 100 is configured to supply bed material to the bypass chamber 200.

More precisely, if the floors 102, 202 are arranged on the same vertical level, the fifth lower edge 552 is arranged at a higher vertical level than this. However, if the floors 102, 202 are not arranged on the same vertical level, the fifth lower edge 552 is arranged at a higher vertical level than the higher floor of these two. In this way, the inlet chamber 100 is configured to supply bed material to the bypass chamber 200 from between the fifth lower edge 552 of the fifth wall 550 and floor(s) (102, 202) of the inlet chamber 100 and the bypass chamber 200. The fifth lower edge 552 needs not be as wide as the inlet chamber 100 or the bypass chamber 200. In contrast, the fifth lower edge 552 may be an upper edge of an aperture provided in the fifth wall 550.

Preferably, the floors 102, 202 of the inlet chamber 100 and the bypass chamber 200 are arranged on the same vertical level. Moreover, preferably the fifth lower edge 552 of the fifth wall 550 is not arranged on top of a part of the fifth wall 550. I.e. if the fifth lower edge 552 is an upper edge of an aperture, the aperture extends to the level of the floor (or higher of the floors). This has the effect that the bed material may easily run from the inlet chamber 100 to the bypass chamber 200.

The bypass chamber 200 is suitable for bypassing the first and second heat exchanger tubes (810, 820) of the heat exchanger 10. This has the effect that the amount of bed material, from which heat will be recovered, can be controlled. In order to control bed material flow through the bypass chamber 200, the heat exchanger 10 comprises fourth nozzles 940 arranged at a lower part of the bypass chamber 200 (see FIG. 3). The fourth nozzles 940 are configured to fluidize bed material in the bypass chamber 200.

Figure 5:
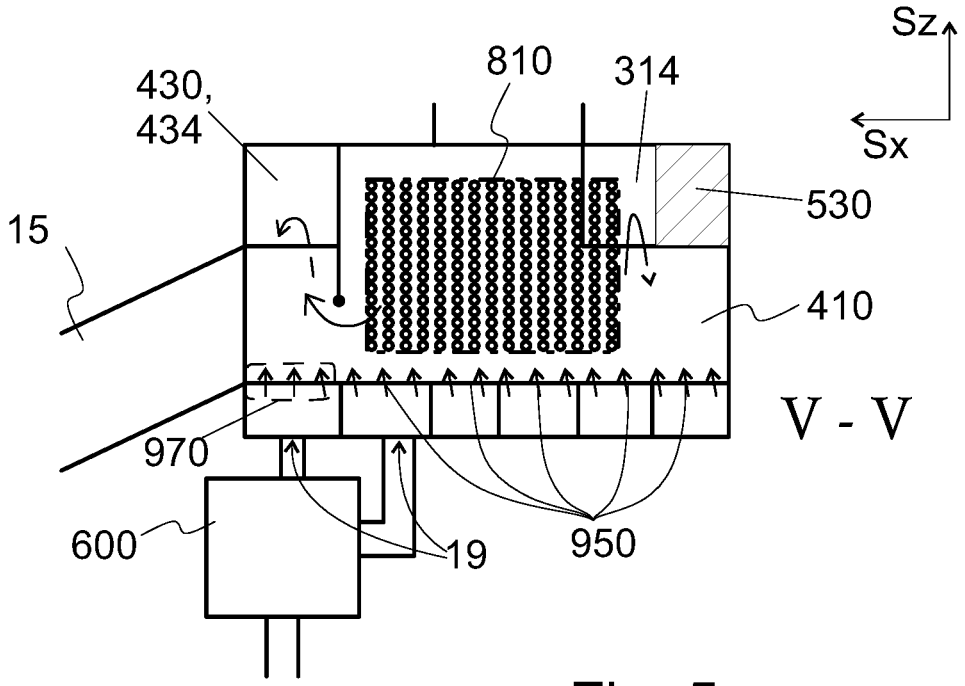
FIG. 5 shows the sectional view V-V of the heat exchanger of FIG. 2, the section V-V indicated in FIG. 2, FIGS. 6*a* to 6*d* show embodiments of nozzles for feeding fluidizing gas.

Even if the nozzles 911, 912 in the first feeding chamber 310 affect the material flow to the first heat exchanger tuber 810, preferably, the bed material flow within the first heat exchange chamber 410 is also enhanced by fluidizing gas. Therefore, in an embodiment, the heat exchanger comprises fifth nozzles 950 arranged at a lower part of the first heat exchange chamber 410. The fifth nozzles 950 are configured to fluidize bed material in the first heat exchange chamber 410. Reference is made to FIGS. 4*a*, 4*b*, and 5.

Even if the nozzles 921, 922 in the second feeding chamber 320 affect the material flow to the second heat exchanger tubes 820, preferably, the bed material flow within the second heat exchange chamber 420 is also enhanced by fluidizing gas. Therefore, in an embodiment, the heat exchanger comprises sixth nozzles 960 arranged at a lower part of the second heat exchange chamber 420. The sixth nozzles 960 are configured to fluidize bed material in the second heat exchange chamber 420. Reference is made to FIGS. 4*a* and 4*b*.

For similar reasons, in an embodiment, the heat exchanger comprises seventh nozzles 970 configured to fluidize bed material in the first outlet chamber 430 (see FIG. 5). For similar reasons, in an embodiment, the heat exchanger comprises eighth nozzles (not shown) configured to fluidize bed material in the second outlet chamber 440.

The invention claimed is:

1. A heat exchanger suitable for recovering heat from bed material of a fluidized bed boiler, the heat exchanger comprising:

first heat exchanger tubes, second heat exchanger tubes, a first feeding chamber configured to supply bed material to the first heat exchanger tubes, a second feeding chamber configured to supply bed material to the second heat exchanger tubes, and a first wall that limits the first feeding chamber and the second feeding chamber, the first wall comprising a first lower edge that is arranged at a higher vertical level than a floor or floors of the first feeding chamber and the second feeding chamber, wherein:

the first heat exchanger tubes are arranged only on a first side of a plane and the second heat exchanger tubes are arranged only on a second side of the plane, the first feeding chamber is configured to supply bed material to the second feeding chamber, and the first feeding chamber is configured to supply bed material to the second feeding chamber from between the first lower edge of the first wall and floor(s) of the first and second feeding chambers.

2. The heat exchanger of claim 1, wherein:

the first feeding chamber is configured to supply bed material only to the first heat exchanger tubes and to the second feeding chamber, and the second feeding chamber configured to supply bed material only to the second heat exchanger tubes.

3. The heat exchanger of claim 1, further comprising:

primary first nozzles arranged at a lower vertical level than the first lower edge of the first wall and in the first feeding chamber, the primary first nozzles being configured to fluidize bed material in the first feeding chamber; and primary second nozzles arranged at a lower vertical level than the first lower edge of the first wall and in the second feeding chamber, the primary second nozzles being configured to fluidize bed material in the second feeding chamber.

4. The heat exchanger of claim 1, further comprising:

secondary first nozzles arranged at a higher vertical level than the first lower edge of the first wall and in the first feeding chamber, the secondary first nozzles being configured to fluidize bed material in the first feeding chamber; and secondary second nozzles arranged at a higher vertical level than the first lower edge of the first wall and in the second feeding chamber, the secondary second nozzles being configured to fluidize bed material in the second feeding chamber.

5. The heat exchanger of claim 3, further comprising:

secondary first nozzles arranged at a higher vertical level than the first lower edge of the first wall and in the first feeding chamber, the secondary first nozzles being configured to fluidize bed material in the first feeding chamber; and secondary second nozzles arranged at a higher vertical level than the first lower edge of the first wall and in the second feeding chamber, the secondary second nozzles being configured to fluidize bed material in the second feeding chamber.

6. The heat exchanger of claim 1, wherein:

the second heat exchanger tubes are arranged in a second heat exchange chamber of the heat exchanger;

the second feeding chamber comprises an outlet for supplying bed material to the second heat exchange chamber; and the outlet of the second feeding chamber is arranged at a higher vertical level than the first lower edge.

7. The heat exchanger of claim 1, further comprising:

a second wall that limits an inlet chamber and the first feeding chamber, and an inlet for receiving bed material, the inlet being arranged in the inlet chamber, wherein:

the second wall comprises a second lower edge that is arranged at a higher vertical level than a floor or floors of the inlet chamber and the first feeding chamber, and the inlet chamber is configured to supply bed material to the first feeding chamber from between the second lower edge of the second wall and floor(s) of the inlet chamber and the first feeding chamber.

8. The heat exchanger of claim 7, further comprising:

a first wall that limits the first feeding chamber and the second feeding chamber, the first wall comprising a first lower edge that is arranged at a higher vertical level than a floor or floors of the first feeding chamber and the second feeding chamber, wherein:

the second wall is parallel to the first wall, the first lower edge is not arranged at a lower vertical level than the second lower edge, and the first feeding chamber is configured to supply bed material to the second feeding chamber from between the first lower edge of the first wall and floor(s) of the first and second feeding chambers.

9. The heat exchanger of claim 7, wherein the first feeding chamber is arranged between the inlet chamber and the second feeding chamber.

10. The heat exchanger of the claim 8, wherein:

the first heat exchanger tubes are arranged in a first heat exchange chamber of the heat exchanger;

the first feeding chamber comprises an outlet for supplying bed material to the first heat exchange chamber of the heat exchanger; and the outlet of the first feeding chamber is arranged at a higher vertical level than the first lower edge and/or the outlet of the first feeding chamber is arranged at a higher vertical level than the second lower edge.

11. The heat exchanger of claim 1, wherein:

the heat exchanger further comprises:

a third wall limiting a first heat exchange chamber provided with the first heat exchanger tubes, and a fourth wall limiting a second heat exchange chamber provided with the second heat exchanger tubes, and wherein:

the third wall is parallel to the fourth wall, and at least a part of the first wall is arranged between the third wall and the fourth wall.

12. The heat exchanger of the claim 1, wherein:

the heat exchanger further comprises:

a fifth wall limiting a bypass chamber and an inlet chamber, the fifth wall comprising a fifth lower edge that is arranged at a higher vertical level than a floor or floors of the inlet chamber and the bypass chamber, and the inlet chamber is configured to supply bed material to the bypass chamber, and the bypass chamber is suitable for bypassing the heat exchanger tubes of the heat exchanger.

13. A circulating fluidized bed boiler, comprising:

a furnace, a particle separator configured to separate bed material from flue gases receivable from the furnace, and a loopseal configured to receive the separated bed material from the particle separator, the loopseal comprising a heat exchanger comprising:

first heat exchanger tubes, second heat exchanger tubes, a first feeding chamber configured to supply bed material to the first heat exchanger tubes, and a second feeding chamber configured to supply bed material to the second heat exchanger tubes, wherein:

the first heat exchanger tubes are arranged only on a first side of a plane and the second heat exchanger tubes are arranged only on a second side of the plane, and the first feeding chamber is configured to supply bed material to the second feeding chamber;

wherein:

the heat exchanger being arranged such that at least a part of the separated bed material is configured to run through the first feeding chamber, a first part of the separated bed material is configured to run from the first feeding chamber to the first heat exchanger tubes, and a second part of the separated bed material is configured to run from the first feeding chamber to the second feeding chamber and through the second feeding chamber to the second heat exchanger tubes; and wherein the heat exchanger further comprises:

a first wall that limits the first feeding chamber and the second feeding chamber, the first wall comprising a first lower edge that is arranged at a higher vertical level than a floor or floors of the first feeding chamber and the second feeding chamber, primary first nozzles arranged at a lower vertical level than the first lower edge of the first wall and in the first feeding chamber, and configured fluidize bed material in the first feeding chamber, and primary second nozzles arranged at a lower vertical level than the first lower edge of the first wall and in the second feeding chamber, and configured fluidize bed material in the second feeding chamber, wherein the first feeding chamber is configured to supply bed material to the second feeding chamber from between the first lower edge of the first wall and floor(s) of the first and second feeding chambers; and wherein an amount of fluidizing air fed through the primary first nozzles is configured to be controlled independently of an amount of fluidizing air fed through the primary second nozzles.

14. The circulating fluidized bed boiler of claim 13, wherein:

the heat exchanger comprises:

secondary first nozzles arranged at a higher vertical level than the first lower edge of the first wall and in the first feeding chamber, and configured fluidize bed material in the first feeding chamber, and secondary second nozzles arranged at a higher vertical level than the first lower edge of the first wall and in the second feeding chamber, and configured fluidize bed material in the second feeding chamber, wherein the first feeding chamber is configured to supply bed material to the second feeding chamber from between the first lower edge of the first wall and floor(s) of the first and second feeding chambers; and wherein an amount of fluidizing air fed through the secondary first nozzles is configured to be controlled independently of an amount of fluidizing air fed through the secondary second nozzles.

15. A heat exchanger suitable for recovering heat from bed material of a fluidized bed boiler, the heat exchanger comprising:

first heat exchanger tubes, second heat exchanger tubes, a first feeding chamber configured to supply bed material to the first heat exchanger tubes, and a second feeding chamber configured to supply bed material to the second heat exchanger tubes, wherein:

the first heat exchanger tubes are arranged only on a first side of a plane and the second heat exchanger tubes are arranged only on a second side of the plane, the first feeding chamber is configured to supply bed material to the second feeding chamber, the first feeding chamber is configured to supply bed material only to the first heat exchanger tubes and to the second feeding chamber, and the second feeding chamber configured to supply bed material only to the second heat exchanger tubes.

16. A heat exchanger suitable for recovering heat from bed material of a fluidized bed boiler, the heat exchanger comprising:

first heat exchanger tubes, second heat exchanger tubes, a first feeding chamber configured to supply bed material to the first heat exchanger tubes, a second feeding chamber configured to supply bed material to the second heat exchanger tubes, a second wall that limits an inlet chamber and the first feeding chamber, and an inlet for receiving bed material, the inlet being arranged in the inlet chamber, wherein:

the first heat exchanger tubes are arranged only on a first side of a plane and the second heat exchanger tubes are arranged only on a second side of the plane, the first feeding chamber is configured to supply bed material to the second feeding chamber, the second wall comprises a second lower edge that is arranged at a higher vertical level than a floor or floors of the inlet chamber and the first feeding chamber, and the inlet chamber is configured to supply bed material to the first feeding chamber from between the second lower edge of the second wall and floor(s) of the inlet chamber and the first feeding chamber.

17. A heat exchanger suitable for recovering heat from bed material of a fluidized bed boiler, the heat exchanger comprising:

first heat exchanger tubes, second heat exchanger tubes, a first feeding chamber configured to supply bed material to the first heat exchanger tubes, a second feeding chamber configured to supply bed material to the second heat exchanger tubes, a wall limiting a bypass chamber and an inlet chamber, the wall comprising a lower edge that is arranged at a higher vertical level than a floor or floors of the inlet chamber and the bypass chamber, wherein:

the first heat exchanger tubes are arranged only on a first side of a plane and the second heat exchanger tubes are arranged only on a second side of the plane, the first feeding chamber is configured to supply bed material to the second feeding chamber, the inlet chamber is configured to supply bed material to the bypass chamber, and the bypass chamber is suitable for bypassing the heat exchanger tubes of the heat exchanger.

18. A circulating fluidized bed boiler, comprising:

a furnace, a particle separator configured to separate bed material from flue gases receivable from the furnace, and a loopseal configured to receive the separated bed material from the particle separator, the loopseal comprising a heat exchanger comprising:

first heat exchanger tubes, second heat exchanger tubes, a first feeding chamber configured to supply bed material to the first heat exchanger tubes, and a second feeding chamber configured to supply bed material to the second heat exchanger tubes, wherein:

the first heat exchanger tubes are arranged only on a first side of a plane and the second heat exchanger tubes are arranged only on a second side of the plane, and the first feeding chamber is configured to supply bed material to the second feeding chamber;

wherein:

the heat exchanger being arranged such that at least a part of the separated bed material is configured to run through the first feeding chamber, a first part of the separated bed material is configured to run from the first feeding chamber to the first heat exchanger tubes, and a second part of the separated bed material is configured to run from the first feeding chamber to the second feeding chamber and through the second feeding chamber to the second heat exchanger tubes, and where the heat exchanger further comprises:

a first wall that limits the first feeding chamber and the second feeding chamber, the first wall comprising a first lower edge that is arranged at a higher vertical level than a floor or floors of the first feeding chamber and the second feeding chamber, secondary first nozzles arranged at a higher vertical level than the first lower edge of the first wall and in the first feeding chamber, and configured fluidize bed material in the first feeding chamber, and secondary second nozzles arranged at a higher vertical level than the first lower edge of the first wall and in the second feeding chamber, and configured fluidize bed material in the second feeding chamber, wherein the first feeding chamber is configured to supply bed material to the second feeding chamber from between the first lower edge of the first wall and floor(s) of the first and second feeding chambers; and wherein an amount of fluidizing air fed through the secondary first nozzles is configured to be controlled independently of an amount of fluidizing air fed through the secondary second nozzles.

* * * * *